US005811213A

United States Patent [19]

Chiba

[11] Patent Number: 5,811,213

[45] Date of Patent: Sep. 22, 1998

[54] MAGENTA TONER FOR DEVELOPING ELECTROSTATIC IMAGES AND PROCESS FOR PRODUCTION THEREOF

[75] Inventor: Tatsuhiko Chiba, Kamakura, Japan

[73] Assignee: Canon Kabushiki Kaisha, Tokyo, Japan

[21] Appl. No.: 921,544

[22] Filed: Sep. 2, 1997

[30] Foreign Application Priority Data

Sep. 2, 1996 [JP] Japan ..... 6-231551

[51] Int. Cl.[6] ..... G03G 9/09

[52] U.S. Cl. ..... 430/106; 430/137

[58] Field of Search ..... 430/106, 137

[56] References Cited

U.S. PATENT DOCUMENTS

| | | | |
|---|---|---|---|
| 3,160,510 | 12/1964 | Ehrich . | |
| 4,777,105 | 10/1988 | Macholdt et al. | 430/109 |
| 5,102,761 | 4/1992 | Ohsaki et al. | 430/106 |
| 5,137,576 | 8/1992 | Macholdt et al. | 106/495 |
| 5,407,776 | 4/1995 | Kanbayashi et al. | 430/137 |
| 5,578,407 | 11/1996 | Kasuya et al. | 430/137 |
| 5,635,325 | 6/1997 | Inaba et al. | 430/106 |
| 5,691,093 | 11/1997 | Kanbayashi et al. | 430/47 |
| 5,712,072 | 1/1998 | Inaba et al. | 430/110 |

FOREIGN PATENT DOCUMENTS

| | | |
|---|---|---|
| 0396086 | 11/1990 | European Pat. Off. . |
| 0533172 | 3/1993 | European Pat. Off. . |
| 1217333 | 5/1966 | Germany . |
| 49-46951 | 12/1974 | Japan . |
| 55-26574 | 2/1980 | Japan . |
| 55-42383 | 10/1980 | Japan . |
| 59-57256 | 4/1984 | Japan . |
| 64-22477 | 1/1989 | Japan . |
| 2-210459 | 8/1990 | Japan . |

*Primary Examiner*—Roland Martin

*Attorney, Agent, or Firm*—Fitzpatrick, Cella, Harper & Scinto

[57] ABSTRACT

A magenta toner for developing an electrostatic image is formed of magenta toner particles containing at least a binder resin, a magenta pigment and a polar resin. The binder resin comprises a styrene polymer, a styrene copolymer or a mixture thereof. The magenta pigment comprises a solid solution pigment of C.I. Pigment Red 122 and C.I. Pigment Violet 19, or a solid solution pigment of C.I. Pigment Red 202 and C.I. Pigment Violet 19, and the polar resin has an acid value of 3–20 mgKOH/g. The magenta toner particles are preferably formed through suspension polymerization of a polymerizable monomer mixture including at least styrene monomer, the solid solution pigment and the polar resin. With the aid of the polar resin, the solid solution pigment can be well dispersed in the resultant magnetic toner particles to fully exhibit its coloring power.

70 Claims, 1 Drawing Sheet

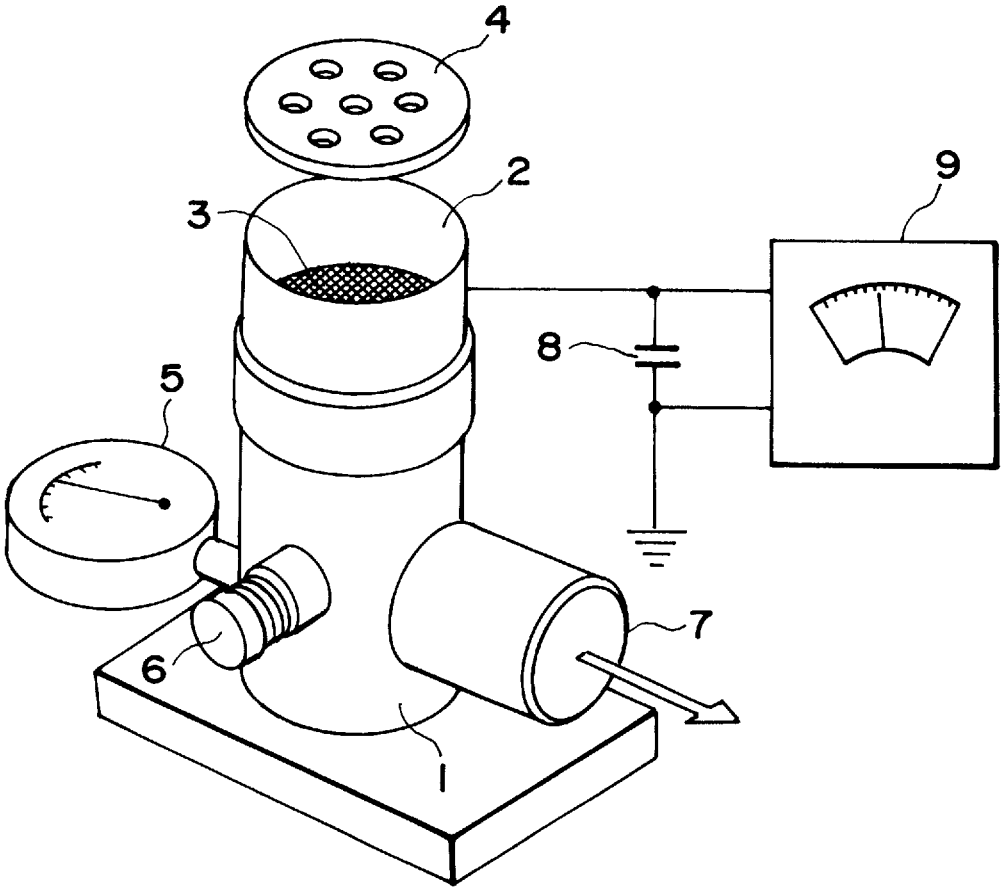
4
2
9
3
8
5
7
6
1

MAGENTA TONER FOR DEVELOPING ELECTROSTATIC IMAGES AND PROCESS FOR PRODUCTION THEREOF

FIELD OF THE INVENTION AND RELATED ART

The present invention relates to a magenta toner for developing electrostatic images formed by image forming methods, such as electrophotography and electrostatic printing, and a process for production thereof. More specifically, the present invention relates to a magenta toner having a stable triboelectric chargeability and suitable for developing electrostatic images to form full-color images of high-image quality and excellent color reproduction In recent years, digital full-color copying machines and printers have been commercialized to provide high-quality images with not only high resolution and gradation characteristic but also excellent color reproducibility free from color irregularity.

In a digital full-color copying machine, a color image original is color-separated by color filters of B (blue), G (green) and R (red) to form electrostatic latent images in a dot size of 20 $\mu$m to 70 $\mu$m for the respective colors, the latent images are developed with respective color toners of Y (yellow), M (magenta), C (cyan) and B (black), and the resultant superposed color toner images are subjected to subtractive color mixing during heat-pressure fixation to reproduce the original color image. Accordingly, a larger amount of toner has to be transferred from a photosensitive member to a transfer-receiving material, such as paper, via or without via an intermediate transfer member, than in a white and black monochromatic copying machine.

Among the color toners, a magenta toner is important for reproducing a human skin color which is a halftone color requiring a good developing performance of the toner.

Hitherto, known colorants for magenta toners include quinacridone colorants, thioindigo colorants, xanthene colorants, monoazo colorants, perylene colorants, and diketopyrrolopyrrole colorants.

For example, Japanese Patent Publication (JP-B) 49-46951 has proposed a 2,9-dimethylquinacridone pigment; Japanese Laid-Open Patent Application (JP-A) 55-26574 has proposed a thioindigo pigment; JP-A 59-57256 has proposed a xanthene dye; JP-A 2-210459 has proposed a diketopyrrolopyrrole pigment; and JP-B 55-42383 has proposed an anthraquinone dye.

Further, in order to adjust the transparency and hue of a colorant, it has been also proposed to use a mixture of pigment-pigment or pigment-dye (JP-A 1-22477) and a quinacridone pigment in a mixed crystal state (U.S. Pat. No. 4,777,105), instead of using a single pigment compound.

These magenta colorants have a good affinity with a binder resin and good light-fastness and provide magenta toners which have generally good triboelectric chargeability and color hue, but it has been desired to provide a magenta toner having further improved hue, saturation and electrophotographic characteristics in order to provide images which have a satisfactory transparency and are more faithful to the original.

SUMMARY OF THE INVENTION

A generic object of the present invention is to provide a magenta toner for developing electrostatic images having solved the above-mentioned problems.

A more specific object of the present invention is to provide a magenta toner for developing electrostatic images capable of providing a very clear color at a high image density.

Another object of the present invention is to provide a magenta toner for developing electrostatic images capable of providing a fixed image having excellent transparency on an OHP sheet.

Another object of the present invention is to provide a magenta toner for developing electrostatic images having an excellent reproducibility of a highlight (or halftone) portion.

Another object of the present invention is to provide a magenta toner for developing electrostatic images having an excellent negative chargeability and excellent electrophotographic performances.

A further object of the present invention is to provide a process for producing such a magenta toner.

According to the present invention, there is provided a magenta toner for developing an electrostatic image, comprising magenta toner particles containing at least a binder resin, a magenta pigment and a polar resin;

wherein the binder resin comprises a styrene polymer, a styrene copolymer or a mixture thereof, the magenta pigment comprises a solid solution pigment of C.I. Pigment Red 122 and C.I. Pigment Violet 19, or a solid solution pigment of C.I. Pigment Red 202 and C.I. Pigment Violet 19, and the polar resin has an acid value of 3–20 mgKOH/g.

According to another aspect of the present invention, there is provided a process for producing a magenta toner comprising magenta toner particles, comprising the steps of:

mixing at least one monomer including at least styrene monomer and optional another vinyl monomer, a magenta pigment, a polar resin and a polymerization initiator to prepare a polymerizable monomer mixture, dispersing the polymerizable monomer mixture into an aqueous medium to form particles of the polymerizable monomer mixture, and polymerizing said at least one monomer in the particles of the polymerizable monomer mixture to form a binder resin and convert the particles into magenta toner particles;

wherein the binder resin comprises a styrene polymer, a styrene copolymer or a mixture thereof, the magenta pigment comprises a solid solution pigment of C.I. Pigment Red 122 and C.I. Pigment Violet 19, or a solid solution pigment of C.I. Pigment Red 202 and C.I. Pigment Violet 19, and the polar resin has an acid value of 3–20 mgKOH/g.

These and other objects, features and advantages of the present invention will become more apparent upon a consideration of the following description of the preferred embodiments of the present invention taken in conjunction with the accompanying drawings.

BRIEF DESCRIPTION OF THE DRAWING

A sole FIGURE in the drawing is a schematic illustration of an apparatus for measuring a triboelectric chargeability of a toner.

DETAILED DESCRIPTION OF THE INVENTION

A characteristic feature of the toner according to the present invention is that the toner particles contain a specific solid solution pigment and a polar resin having a specific acid value.

The solid solution pigment used in the present invention may generally be prepared by mixing at least the two species of magenta pigments before the dehydration and pigmentization steps, followed by dehydration and pigmentization. The solid solution pigment is easily disintegratable and can be dispersed into pigment particles close to primary particles.

The pigments constituting the solid solution pigment may preferably comprise those having a structural similarity in combination because of the structural stability and the easiness of production of the solid solution pigment. Particularly, the combination of a substituted quinacridone pigment and non-substituted quinacridone pigment as shown below is used in the present invention in view of excellent light-fastness and coloring power.

Magenta solid solution pigment (1):

Solid solution of C.I. Pigment Red 122 and C.I. Pigment Violet 19:

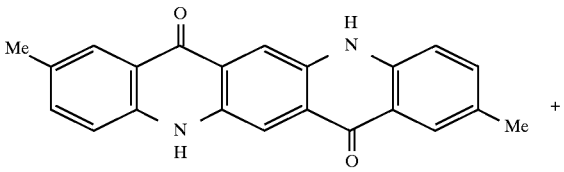

(1) C.I. Pigment Red 122,

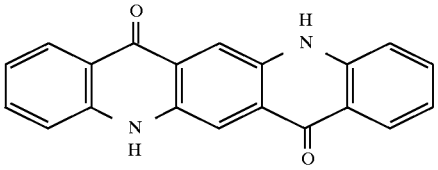

(2) C.I. Pigment Violet 19

Magenta solid solution pigment (2):

Solid solution of C.I. Pigment Red 202 and C.I Pigment Violet 19.

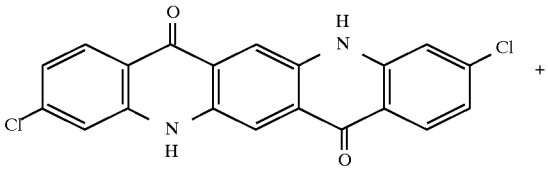

(3) C.I. Pigment Red 202,

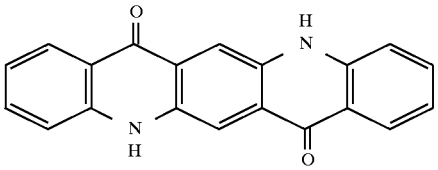

(2) C.I. Pigment Violet 19

Because of its crystal structure, C.I. Pigment Violet 19 is liable to change its light-fastness and coloring power, which are however stabilized by formation of solid solution. The color hue of the solid solution pigment may be varied to have a broadened hue space by changing the content of C.I. Pigment Violet 19 and the conditions for crystallization thereof without impairing the saturation and lightness of the pigment.

In order to attain preferred levels of saturation and coloring power, the substituted quinacridone pigment and the non-substituted quinacridone pigment may preferably be contained in a weight ratio of 85:15–30:70, more preferably 80:20–50:50.

If the content of the substituted quinacridone pigment in the solid solution pigment exceeds 85 wt. %, a minute secondary crystalline structure of the substituted quinacridone alone is liable to be formed in the solid solution to result in a slightly lower saturation.

If the substituted quinacridone pigment content in the solid solution pigment is below 30 wt. %, a minute secondary crystal structure (e.g., γ-form quinacridone) of the non-substituted quinacridone alone is liable to be formed in the solid solution to result in a slight lowering in coloring power.

The solid solution pigment may be formed, e.g., through a process wherein the solid solution components are simultaneously recrystallized from sulfuric acid or an appropriate solvent, optionally ground with a salt and then treated with a solvent (as disclosed in U.S. Pat. No. 3,160,510), or a process wherein a mixture of appropriately substituted diamino-terephthalic acid compounds is cyclized and treated with a solvent (as disclosed in DE-B 1217333).

The magenta toner particles in the magenta toner may preferably be formed through a process including the steps of:

mixing at least one monomer including at least styrene monomer and optional another vinyl monomer, a magenta pigment, a polar resin and a polymerization initiator to prepare a polymerizable monomer mixture, dispersing the polymerizable monomer mixture into an aqueous medium to form particles of the polymerizable monomer mixture, and polymerizing said at least one monomer in the particles of the polymerizable monomer mixture to form a binder resin and convert the particles into magenta toner particles.

According to the above-described, process, during the preparation of the polymerizable monomer mixture, the magenta solid solution pigment is dispersed as particles close to primary particles, and the re-agglomeration of the dispersed particles of the magenta solid solution pigment having a nitrogen atom is suppressed owing to the polar resin having an acid value of 3–20 mgKOH/g, thereby increasing the coloring power, lightness and saturation of the magenta toner particles.

The polar resin used in the present invention exhibits both a function of being uniformly dispersed in the polymerizable monomer mixture to suppress the re-agglomeration of the solid solution pigment particles and a function of stabilizing the dispersion of the polymerizable monomer mixture particles in the aqueous medium in an early stage of polymerization of the polymerizable monomer mixture, so that it is important that the polar resin has an acid value in the range of 3–20 mgKOH/g.

If the acid value of the polar resin is below 3 mgKOH/g, the polar resin and the solid solution pigment have a low affinity therebetween and are liable to be separated from each other, thus exhibiting only a low re-agglomeration suppression effect to result in lower coloring power and chargeability. If the acid value of the polar resin exceeds 20 mgKOH/g, the agglomeratability between the molecular chains of the polar resin, the dispersibility of the polar resin in styrene monomer (which is a non-polar liquid) is lowered, so that the effect of stabilization of the polymerizable monomer mixture particles in the aqueous medium due to the polar polymer is lowered to provide a lower stability of production of the magenta toner particles.

In view of the effect of suppressing reagglomeration of the solid solution pigment particles, the polar resin may preferably be contained in a proportion of 1–20 wt. %, more preferably 2.0–10.0 wt. %, further preferably in a proportion satisfying the following formula (A):

$$5.0 \leq [\text{acid value of polar resin (mgKOH/g)} \times \text{content (wt. \%) of the solid solution pigment/content (wt. \%) of the polar resin}] \leq 20.0 \quad \text{Formula (A)}$$

If the polar resin content is below 1 wt. %, the addition effect thereof is scarce, thus being liable to result in a lower negative triboelectric chargeability of the resultant toner. If the polar resin content exceeds 20 wt. %, the polymerizable monomer mixture is caused to have an increased viscosity so that the particulation thereof in the aqueous medium becomes difficult to lower the production stability.

When the value given by the above formula is below 5, the resultant magenta toner is liable to cause fog and toner scattering.

On the other hand, when the above formula value exceeds 20, fine particles are liable to be formed in an increased amount during he production of magenta toner particles by polarization in the aqueous medium.

It is preferred that the polar resin does not contain an unsaturation group reactive with styrene monomer. When a polar monomer having an unsaturation group is used, the styrene monomer and the polar resin are liable to form a crosslinkage to result in a toner exhibiting a lower color mixability.

Examples of the polar resin may include: saturated polyester resin, epoxy resin, styrene-acrylic acid copolymer, styrene-methacrylic acid copolymer, and styrene-maleic acid copolymer. Among these polar resins, saturated polyester resin or epoxy resin is preferred, and particularly saturated polyester resin is preferred in view of easy controllability of acid value, and flowability, negative triboeletric chargeability and transparency of the resultant toner particles The polar resin may preferably have a number average molecular weight (Mn) of $2.5\times10^3$–$1.0\times10^4$ in view of the solubility thereof in styrene monomer, effect of suppressing re-agglomeration of the solid solution pigment particles, and continuous image forming performance on a large number of sheets of the resultant magenta toner particles.

In the present invention, it is preferred to prepare a polymerizable monomer mixture by dispersing and sufficiently mixing the solid solution pigment and the polar resin in styrene monomer in advance, and then adding thereto a polymerization initiator.

The polymerizable monomer mixture containing styrene monomer can further contain, as desired, another vinyl monomer, examples of which may include:

- substituted styrene monomers, such as o (or m,p)-methylstyrene, and m (or p)-ethylstyrene;
- (meth)acrylate monomers, such as methyl (meth)acrylate, ethyl (meth)-acrylate, propyl (meth)acrylate, butyl (meth)acrylate, octyl (meth)acrylate, dodecyl (meth) acrylate, stearyl (meth)acrylate, behenyl (meth) acrylate, 2-ethylhexyl (meth)acrylate, dimethylaminoethyl (meth)acrylate, and diethylaminoethyl (meth) acrylate; and butadiene, isoprene, cyclohexane, (meth) acrylonitrile, and acrylamide. It is preferred to use an appropriate mixture of styrene monomer and another monomer so as to provide a theoretical glass transition temperature (Tg) as calculated in a manner described in Polymer Handbook, 2nd Ed. III, p.p. 139–192 (John Wiley & Sons) of 50°–85° C. If the theoretical glass transition temperature (Tg) is below 50° C., the storage stability and the continuous image formation characteristic of the resultant toner are liable to be problematic. On the other hand, in excess of 85° C., the transparency of an OHP image in full-color image formation is liable to be lowered.

The THF-soluble content in the toner including the binder resin (i.e., styrene polymer, styrene-copolymer or a mixture of these) and the polar resin may preferably have a molecular weight distribution including a number-average molecular weight (Mn) of $5\times10^3$–$1\times10^6$, and a ratio of weight-average molecular weight (Mw) to number-average molecular weight (Mw/Mn) of 2–100, more preferably 5–50.

The magenta toner particles of the present invention may preferably comprise 65–98 wt. % of the binder resin (i.e., styrene polymer, styrene copolymer or mixture of these), 1–15 wt. % of the magenta pigment, and 1–20 wt. %, more preferably 2.0–10.0 wt. %, of the polar resin.

In order to provide an improved anti-offset characteristic and an improved dispersibility of the solid solution pigment in the magenta toner, the magenta toner may preferably contain a low-softening point substance exhibiting a heat-absorption main peak in a temperature range of 50°–130° C., more preferably 55°–110° C., on a DSC heat-absorption main peak as measured according to ASTM D3418-8. If the heat-absorption main peak temperature is below 50° C., the low-softening point substance can exhibit only a weak cohesion to provide an inferior anti-high-temperature offset characteristic, and this is particularly undesirable for a magenta toner for full-color image formation. On the other hand, if the heat-absorption main peak temperature exceeds 130° C., the resultant magenta toner is liable to have inferior low-temperature fixability and transparency.

The heat-absorption main peak temperature measurement may be performed by using a differential scanning calorimeter (e.g., "DSC-7", available from Perkin-Elmer Corp.) in a temperature range of 20°–200° C. The temperature calibration of the detector unit may be performed by using the melting points of indium and zinc, and the calorie calibration may be performed by using the heat of fusion of indium. The measurement may be performed at a temperature-raising rate of 10° C./min. by placing a sample on an aluminum pan while setting a blank pan as a control.

In view of the anti-offset characteristic and continuous image forming performance on a large number of sheets of the magenta toner, the low-softening point substance may preferably be contained in 5–25 wt. % of the toner particles.

The low-softening point substance may preferably comprise a wax so as to provide an easy meltability in heat-pressure fixation. It is particularly preferred to use a wax comprising an ester compound having a long-chain ester unit represented by $R_1$—CO.O— or $R_1$—O.CO—, wherein $R_1$ is an organic group having 15 or more carbon atoms so as to provide good anti-offset characteristic and transparency. It is particularly preferred to use a wax comprising an ester compound as represented by any of the following formulae (1)–(5):

$$R_2\text{—COO—}R_3, \quad \text{Formula (1)}$$

wherein $R_2$ and $R_3$ denote a saturated hydrocarbon group having 15–45 carbon atoms. $R_2$ and $R_3$ are preferably alkyl groups.

$$R_4\text{—O.CO—}R_5\text{—CO.O—}R_6, \quad \text{Formula (2)}$$

wherein $R_4$ and $R_6$ denote an organic group having 15–32 carbon atoms, and $R_5$ denotes an organic group having 2–20 carbon atoms. $R_4$ and $R_6$ are preferably alkyl groups, and $R_5$ is preferably an alkylene group.

$$R_7\text{—CO.O—}R_8\text{—O.CO—}R_9, \quad \text{Formula (3)}$$

wherein $R_7$ and $R_9$ denote an organic group having 15–32 carbon atoms, and $R_8$ denote an organic group having 2–20 carbon atoms. $R_7$ and $R_9$ are preferably alkyl groups, and $R_8$ is preferably an alkylene group.

Formula (4)

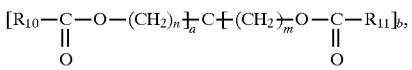

wherein $R_{10}$ and $R_{11}$ denote an organic group having 15–40 carbon atoms, a and b are integers of 0–4 giving a sum a+b=4, and m and n are integers of 0–25 giving m+n≧1. $R_{10}$ and $R_{11}$ are preferably alkyl groups.

Formula (5)

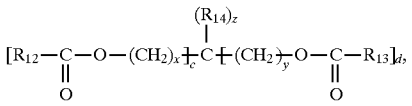

wherein $R_{12}$ and $R_{13}$ denote an organic group having 15–40 carbon atoms, $R_{14}$ denotes a hydrogen atom or an organic group having 1–40 carbon atoms, c and d are integers of 0–3 giving c+d=1 to 3, z is an integer of 1 to 3. $R_{12}$, $R_{13}$ and $R_{14}$ are preferably alkyl groups.

In the present invention, it is preferred to use a wax having a hardness of 0.5–5.0. The wax hardness values referred to herein are based on Vickers hardness values measured by using a cylindrical wax sample having a diameter of 20 mm and a thickness of 5 mm and an ultra-micro hardness meter ("DUH-200", available from Shimazu Seisakusho K.K.). The measurement was performed by using a load of 0.5 g and a loading speed of 9.67 mm/sec until a displacement of 10 $\mu$m was caused. From the depression mark, a Vickers hardness of the sample was measured.

A wax having a hardness of below 0.5 results in a toner having too large pressure-dependence and process-speed dependence of the fixability and also a lower anti-low-temperature offset characteristic. On the other hand, if the hardness exceeds 5.0, the resultant toner is caused to have a lower storage stability and a lower anti-high-temperature offset characteristic because of a small self-cohesion of the wax per se.

Specific examples of the ester compounds contained in ester waxes are enumerated hereinbelow:

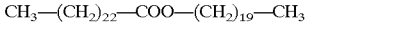

(1)

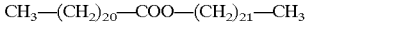

(2)

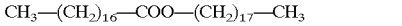

(3)

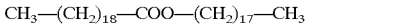

(4)

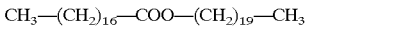

(5)

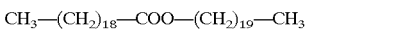

(6)

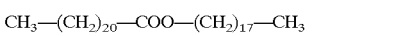

(7)

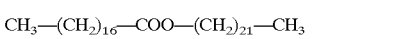

(8)

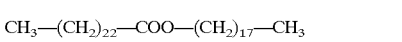

(9)

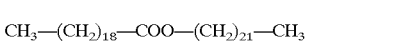

(10)

(11)

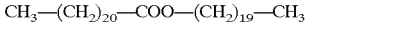

(12)

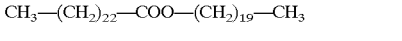

(13)

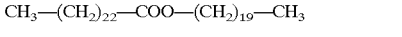

(14)

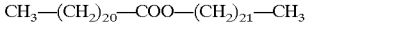

(15)

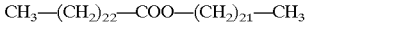

(16)

(17)

(18)

(19)

(20)

(21)

(22)

(23)

(24)

(25)

(26)

(27)

(28)

(29)

(30)

(31)

-continued

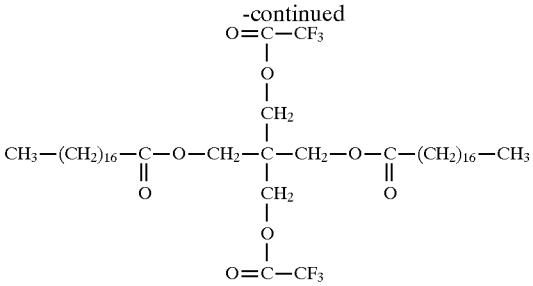

(32)

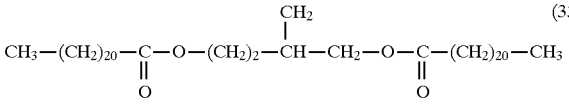

(33)

The magenta toner particles used in the present invention may preferably contain 5–25 wt. % of an ester wax. If the ester wax content is below 5 wt. %, a sufficient effect of addition may not be exhibited to result in a somewhat lower coloring power.

If the ester wax content exceeds 25 wt. % the resultant toner is liable to have inferior continuous image forming performance on a large number of sheets and lower anti-blocking property.

The magenta toner according to the present invention can further contain a negative charge control agent. It is preferred to use a negative charge control agent which is colorless or pale-colored, provides a magenta toner with a quick chargeability and allows the stable maintenance of a constant charge.

In the case of producing magenta toner particles directly through a polymerization process, it is particularly preferred to use a charge control agent which is free from polymerization-inhibiting property and does not contain a component soluble in an aqueous medium. Specific examples of the negative charge control agent may include: metal compounds of salicylic acid, alkylsalicylic acid, dialkylsalicylic acid, naphthoic acid and dicaroxylic acids; polymeric compounds having a side chain comprising a sulfonic acid group or a carboxylic acid group; boron compounds, urea compounds, silicon compounds, and calixarene. Among these, it is particularly preferred to use a metal compound of an aromatic hydroxycarboxylic acid because of colorlessness or pale color, and excellent controllability of negative chargeability. Such a charge control agent may preferably be contained in 0.5–10 wt. % of the magenta toner particles.

Examples of the polymerization initiator usable to be contained in the polymerizable monomer mixture may include: azo- or diazo-type polymerization initiators, such as 2,2'-azobis-(2,4-dimethylvaleronitrile), 2,2'-azobisisobutylonitrile, 1,1'-azobis-(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on a polymerization degree to be attained. The polymerization initiator may generally be used in the range of about 0.5–20 wt. % based on the weight of the polymerizable monomer. The polymerization initiators may somewhat vary depending on the polymerization process used and may be selectively used singly or in mixture with reference to their 10-hour half-life period temperature.

In order to control the molecular weight of the resultant binder resin, it is also possible to add a crosslinking agent, a chain transfer agent, a polymerization inhibitor, etc.

In production of toner particles by the suspension polymerization using a dispersion stabilizer, an inorganic or/and an organic dispersion stabilizer may be added in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–20 wt. parts per 100 wt. parts of the polymerizable monomer mixture. It is also preferred that the dispersion stabilizer is used in a proportion of 0.01 to 0.5 wt. part per 100 wt. parts of water.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization. In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

In the case of direct polymerization, magenta toner particles may preferably be produced in the following manner. Into a polymerizable monomer, the magenta pigment, the polar resin, a low-softening point substance, a charge control agent and other additives may be added, and the mixture is dispersed by an attritor. Then, a polymerization initiator may be added and uniformly dissolved or dispersed by a homogenizer or an ultrasonic dispersing device, to form a polymerizable monomer mixture or composition, which is then dispersed and formed into particles in a dispersion medium containing a dispersion stabilizer by means of an ordinary stirrer, a homomixer or a homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90° C. The temperature can be raised at a later stage of the polymerization. It is also possible to subject a part of the aqueous system to distillation in a latter stage of or after the polymerization in order to remove the yet-unpolymerized part of the polymerizable monomer and a by-product which can cause an odor in the toner fixation step. After the reaction, the produced toner particles are washed, filtered out, and dried. In the suspension polymerization, it is generally preferred to use 300–3000 wt. parts of water as the dispersion medium per 100 wt. parts of the polymerizable monomer mixture.

The magenta toner particles in the magenta toner according to the present invention may preferably have a shape factor SF-1 of 100–150, particularly 100–125. The shape factor SF-1 referred to herein is based on values measured in the following manner.

Images of 100 toner particles observed through a field emission scanning electron microscope (FE-SEM) ("S-800", available from Hitachi Seisakusho K.K.) at a magnification of, e.g., 500 are sampled at random, and the image data of the toner images are inputted for analysis into an image analyzer (e.g., "Luzex III", available from Nireco K.K.) through an interface, whereby the shape factor SF-1 is calculated by the following equation:

$$SF\text{-}1=[(\mathrm{MXLNG})^2/\mathrm{AREA}]\times(\pi/4)\times 100,$$

wherein MXLNG denotes the maximum diameter of a toner particle and AREA denotes the projection area of the toner particle. The shape factor SF-1 referred to herein is defined as a number-average value of SF-1 values calculated in the above-described manner for the 100 toner particles selected at random. A smaller shape factor (closer to 100) represents a shape closer to a true sphere.

In case where the shape factor SF-1 larger than 150, the toner particles are substantially deviated from spheres but approach indefinite or irregularly shaped particles and correspondingly show a lowering in transfer efficiency (or transfer ratio).

Particularly in the case of using an intermediate transfer member so as to be applicable to a wide variety of transfer-receiving materials, substantially two transfer steps are involved, so that a lower transfer ratio results in a lowering in toner utilization efficiency. Further, in a digital full-color copying machine or a digital full-color printer recently developed, it is necessary that a color image original is preliminarily subjected to color separation by using B (blue), G (green) and R (red) filters, and dot latent images of 20–70 μm are formed on a photosensitive member and developed with respective toners in colors of Y (yellow), M (magenta), C (cyan) and B (black), respectively, to reproduce a multi-color image faithful to the original or color data by subtractive color mixing of the toners. In this instance, large quantities of Y, M, C and B toners corresponding to the original or color data from CRT are present on the photosensitive member or intermediate transfer member, so that the respective color toners used in the present invention are required to show a very high transferability. For maintaining such a good transferability, the magenta toner should preferably have a large triboelectric chargeability and a shape factor SF-1 of 100–150.

Further, in order to faithfully reproduce minute latent image dots for providing a high quality image, the toner according to the present invention may preferably have a weight-average particle size of 3–9 μm, particularly 3–8 μm, and a number-basis variation coefficient of particle size of at most 35%. A toner having a weight-average particle size of below 3 μm is liable to show a low transfer ratio, result in much transfer residue toner on the photosensitive member or intermediate transfer member and cause fog and image irregularity due to transfer failure. A toner having a weight-average particle size in excess of 9 μm is liable to result in lower resolution and dot-reproducibility and cause melt-sticking onto various members involved. These liabilities are promoted when the toner has a number-basis particle size variation coefficient in excess of 35%.

Several measurement methods for measuring values referred to herein will be described below.

[Molecular weight distribution]

The molecular-weight distribution of the binder resin and the polar resin may be measured by gel permeation chromatography (GPC) as follows. The toner particles are subjected to extraction with toluene for 20 hours by means of a Soxhlet extractor in advance, followed by distilling-off of the solvent (toluene) from the extract liquid to recover a solid. An organic solvent (e.g., chloroform) in which ester wax is dissolved but the binder resin is not dissolved is added to the solid and sufficiently washed therewith to obtain a residue product. The residue product is dissolved in tetrahydrofuran (THF) and subjected to filtration with a solvent-resistant membrane filter having a pore size of 0.3 μm to obtain a sample solution (THF solution) The sample solution is injected in a GPC apparatus ("GPC-150C", available from Waters Co.) using columns of A-801, 802, 803, 804, 805, 806 and 807 (manufactured by Showa Denko K.K.) in combination. The identification of sample molecular weight and its molecular weight distribution is performed based on a calibration curve obtained by using monodisperse polystyrene standard samples.

[Triboelectric chargeability]

The sole FIGURE in the drawing is an illustration of an apparatus for measuring a toner triboelectric charge. A blend of a sample magenta toner (containing no external additive) and a carrier is placed in a polyethylene bottle of 50–100 ml, and the bottle is shaked by hands for ca. 5 min. to effect triboelectric charging. The carrier is a silicone resin-coated ferrite carrier (having an average particle size of 35 μm) and blended with the toner in a toner/carrier weight ratio of 7/93.

Then, the toner-carrier blend in a weight $M_0$ (of ca. 0.5–1.5 g) is placed in a metal measurement vessel 2 bottomed with a 500-mesh screen 3 and then covered with a metal lid 4. The weight of the entire measurement vessel 2 at this time is weighed at $W_1$ (g). Then, an aspirator 1 (composed of an insulating material at least with respect to a portion contacting the measurement vessel 2) is operated to suck the toner through a suction port 7 while adjusting a gas flow control valve 6 to provide a pressure of 2450 hPa at a vacuum gauge 5. Under this state, the toner is sufficiently removed by sucking, preferably for 2 min.

The triboelectric charge Q (mC/kg) of the sample toner is calculated by the following equation:

$$Q=[(W_1-W_2)/(T\times W_0)]\times C\times V/(W_1-W_2)=C\times V/(T\times W_0),$$

wherein: V (volts) denotes a potential reading at a potentiometer 9; C (μF), a capacitance of a capacitor 8; $W_2$, a weight of the measurement vessel 2 after the sucking; and T, a toner/carrier weight ratio.

Toners prepared in Examples described hereinafter were subjected to measurement of the triboelectric charge Q in environments of high temperature/high humidity (H.T./H.H.=35° C./90% RH), normal temperature/normal humidity (N.T./N.H.=(23° C./60% RH), and low temperature/low humidity (L.T./L.H.=15° C./10% RH) as an evaluation of environmental charging stability.

[Acid value]

2–10 g of a resinous sample is weighed into a 200 ml-Erlenmeyer flask, and ca. 50 ml of methanol/toluene (=30/70) mixture solvents is added thereto to dissolve the sample. Then, a 0.1% mixture indicator of Thymol BLue and Phenol Red is added to the solution, and the solution is titrated with a preliminarily standardized 0.1N-potassium hydroxide/ethanol solution to calculate an acid value of the sample resin from the consumed amount (KOH (ml) of the potassium hydroxide solution:

$$\text{Acid value}=KOH\ (\mathrm{ml})\times F\times 56.1/\text{sample weight (g)},$$

wherein F denotes a factor of the 0.1N-potassium hydroxide/ethanol solution.

[Coloring power]

7 wt. parts of a sample magenta toner is blended with 93 wt. parts of silicone resin-coated ferrite carrier to prepare a two component-type developer. The developer is evaluated by a commercially available full-color copying machine ("CLC 500", made by Canon K.K.) after remodeling thereof for allowing variable fixing temperatures and by omitting the fixing oil applicator system to fix a toner image on a transfer-receiving material (paper having a gloss level 4 and a basis weight of 99 g/m$^2$) and evaluate the fixed image. Thus, a magenta solid image is formed at a toner coating rate of 0.5 mg/cm$^2$ while adjusting the fixation temperature so as to provide the image with a gloss level 10–15. A coloring power is evaluated in terms of the image density of the monochromatic solid image.

The gloss level measurement is performed according to Method 2 of JIS Z8741, and the image density is measured by a reflection densitometer ("RD 918", available from Macbeth Co.).

[Image quality]

7 wt. parts of a sample magenta toner is blended with 93 wt. parts of acrylic resin-coated ferrite carrier to prepare a two component-type developer. The developer is evaluated by a commercially available full-color copying machine ("CLC 500", made by Canon K.K.) after remodeling thereof for allowing variable fixing temperatures and by using a pair of fixing rollers both surfaced with a fluorine-containing resin and omitting the fixing oil applicator system to fix a toner image on a transfer-receiving material (paper having a gloss level 4 and a basis weight of 99 g/m$^2$) and evaluate the fixed image. Thus, a magenta solid image is formed at a toner coating rate of 0.5 mg/cm$^2$ while adjusting the fixation temperature so as to provide the image with a gloss level 10–15. The density level was adjusted by using a gray scale and color patch sheet (made by Eastman Kodak Co.) so as to reproduce the gray scale by full-color images as faithfully as possible and provide a magenta (M) monochromatic image with a maximum density of at least 1:1.

Then, a magenta (M) solid image having an image density of 1.2 is used for evaluation of color reproducibility based on the lightness L* and saturation C*, and a highlight image having an image density of 0.2 is used for evaluation of the image quality uniformity, respectively after formation of the images by the above-mentioned re-modeled full-color copying machine.

For evaluation, a color reproducibility range factor E defined by the following equation was obtained and reset to be as E=100 for the image obtained in Comparative Example 1 described hereinafter:

$$E=[(\text{Lightness } L^*)^2\times(\text{Saturation } C^*)^2]^{1/2}.$$

The relative color reproducibility range factors for images obtained in other Examples and Comparative Examples were obtained and evaluated at 5 levels of A–E according to the following standard.

E>110=A

105<E≦110=B

90<E≦105=C

80<E≦90=D

E≦80=E

The highlight portion uniformity was also evaluated by eye observation at 5 levels of A–E while setting the highlight image of Comparative Example 1 at level "B".

[Transparency of OHP sheet images]

By using a commercially available full-color copying machine ("CLC 500", available from Canon K.K.) after remodeling, a gradational unfixed toner image is formed on an OHP transparency sheet by development and transfer in an environment of temperature 23.5° C./humidity 65% RH at a developing contrast of 320 volts. The unfixed toner image is fixed by an external fixing device having a 40 mm-dia. fixing roller surfaced with a fluorine-containing resin and equipped with no oil applicator system at a fixing temperature of 180° C. and a fixing process speed of 30 mm/sec to obtain a fixed image.

The transmittance at a halftone image density level of 0.4–0.6 of the fixed image of an image obtained in Comparative Example 1 was measured and set to be a relative transmittance (T %) of 100, an the relative transmittances of OHP fixed images obtained in other Examples and Comparative Examples were measured, whereby the transparencies of the fixed images were evaluated at 5 levels of A–E according to the following standard based on the relative transmittances (T %):

T %>110=A

105<T %≦110=B

90<T %≦105=C

80<T %≦90=D

T %≦80=E

The transmittance measurement was performed by using an auto-spectro-photometer ("UV 2200", available from Shimazu Seisakusho K.K.), and the transmittance of a sample image was measured at a maximum absorption wavelength of 650 nm with respect to the transmittance of an OHP sheet per se as 100%.

The present invention will be described more specifically based on Examples.

Production Example 1 of Solid solution pigment

A compound of the following formula:

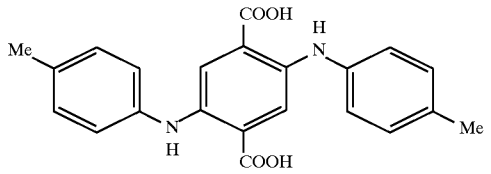

was cyclized in phosphoric acid to form 2,9-dimethylquinacridone. The phosphoric acid containing 2,9-dimethylquinacridone was dispersed in water, and the resultant aqueous dispersion was filtrated to prepare wet crude 2,9-dimethylquinacridone (C.I. Pigment Red 122).

Separately, a compound of the following formula:

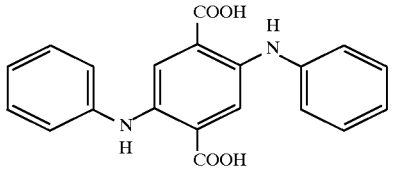

was cyclized in phosphoric acid to form non-substituted quinacridone. The phosphoric acid containing quinacridone was dispersed in water, and the resultant aqueous dispersion was filtrated to prepare wet quinacridone (C.I. Pigment Violet 19).

66 wt. parts of the wet crude 2,9-dimethylquinacridone and 34 wt. parts of the wet crude quinacridone were added to a mixture liquid of 600 wt. parts of water and 300 wt. parts of ethanol placed in a vessel equipped with a condenser, and the 2,9-dimethylquinacridone and quinacridone were ground for 5 hours in the vessel while refluxing the mixture liquid under heating. Thereafter, the resultant solid solution pigment was filtered out, washed, dried and pulverized to obtain Solid solution magenta pigment (1).

Production Example 2 of Solid solution pigment

A compound of the following formula:

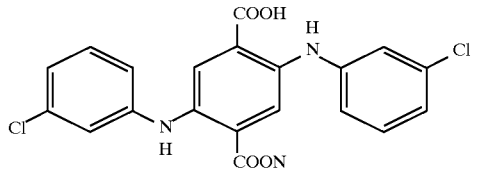

was cyclized in phosphoric acid to form 3,10-dichloroquinacridone. The phosphoric acid containing 3,10-dichloroquinacridone was dispersed in water, and the resultant aqueous dispersion was filtrated to prepare wet crude 3,10-dichloroquinacridone (C.I. Pigment Red 202).

20 wt. parts of the thus-obtained wet crude 3,10-dichloroquinacridone and 80 wt. parts of the wet crude non-substituted quinacridone prepared in Production Example 1 were added to a mixture liquid of 600 wt. parts of water and 300 wt. parts of ethanol placed in a vessel equipped with a condenser, and the 3,10-dichloroquinacridone and quinacridone were ground for 5 hours in the vessel while refluxing the mixture liquid under heating. Thereafter, the resultant solid solution pigment was filtered out, washed, dried and pulverized to obtain Solid solution magenta pigment

EXAMPLE 1

A 0.1M-$Na_3PO_4$ aqueous solution and a 1.0M-$CaCl_2$ aqueous solution were prepared. Into a four-necked flask equipped with a high-speed stirring device ("TK homomixer", madee by Tokushu Kita Kogyo K.K.), 710 wt. parts of deionized water and 450 wt. parts of the 0.1M-$Na_3PO_4$ aqueous were added, and the mixture was stirred at 12,000 rpm. Further, 68 wt. parts of the 1.0M-$CaCl_2$ aqueous solution was added thereto to form an aqueous dispersion medium containing $Ca_3(PO_4)_2$ (fine dispersion stabilizer with little water-solubility).

| | |
|---|---|
| Styrene | 165 wt. parts |
| n-Butyl acrylate | 35 wt. parts |
| Solid solution magenta pigment (1) | 7 wt. parts |
| Saturated polyester resin (polar resin) (polycondensation product of terephthalic acid/propylene oxide-modified bisphenol A/trimellitic acid; A.V. (acid value) = 15 kgKOHg, Mn = 45000, Mp (peak molecular weight) = 6000) | 10 wt. parts |
| Dialkylsalicylic acid metal compound (negative charge control agent) | 2 wt. parts |
| Ester wax ($T_{AP}$ (heat-absorption main-peak temperature) = 64.4° C.; principally consisting of Ester compound (1); Hv (hardness) = 3.2) | 15 wt. parts |

The above ingredients were dispersed for 3 hours by an attritor to form a pigment-dispersed liquid. Then, 1 g of the pigment-dispersed liquid was. diluted with 9 g of styrene monomer, and the resultant dispersion was subjected to a sedimentation test at 70° C. for 48 hours, whereby no precipitation of Solid solution magenta pigment (1) was observed to exhibit good dispersibility of the pigment.

To the above-prepared pigment-dispersed liquid, 2 wt. parts of 2,2'-azobis(2,4-dimethylvaleronitrile) was added to prepare a polymerizable monomer mixture. The polymerizable monomer mixture was charged into the above-prepared aqueous dispersion medium under stirring at 12,000 rpm of the high-speed stirring device and thereby formed into particles within 15 min. Then, the high-speed stirring device was replaced by a propeller blade stirrer, and the system was maintained at 60° C. under stirring at 50 rpm of the propeller blade stirrer for 4 hours and heated to and maintained at 80° C. for 4 hours, to effect totally 8 hours of polymerization. After completion of the polymerization, the resultant slurry was cooled, and dilute hydrochloric acid was added to remove the dispersion stabilizer.

Then, the polymerizate was washed and dried to recover magenta toner particles, which exhibited a weight-average particle size (D4) of 6.2 $\mu$m and a number-basis variation coefficient ($\sigma_{DN}$)=28% according to the Coulter counter measurement and a shape factor SF-1 of 107. The magenta toner particles comprised ca. 200 wt. parts of styrene-n-butyl acrylate copolymer, ca. 7 wt. parts of solid-solution magenta pigment, ca. 10 wt. parts of saturated polyester resin, ca. 2 wt. parts of dialkylsalicylic acid metal compound, and ca. 15 wt. parts of ester wax.

100 wt. parts of the thus obtained magenta toner particles were blended with 2 wt. parts of externally added hydrophobized titanium oxide fine powder to obtain a magenta toner. Further, 7 wt. parts of the magenta toner was blended with 93 wt. parts of acrylic resin-coated ferrite carrier to obtain a two-component type developer, which was evaluated by the re-modeled full-color copying machine ("CLC 500" (available from Canon) after remodeling) with respect to continuous image formation performances. Under the normal temperature/normal humidity (23° C./60% RH) conditions, the developer provided stably clear and good magenta image without lowering in developing performance even after continuous image formation on 20,000 sheets. Further, the magenta toner exhibited good coloring power and OHP transparency.

The results are inclusively shown in Table 2 together with those obtained by other Examples and Comparative Examples described below.

Comparative Example 1

Magenta toner particles were prepared in the same manner as in Example 1 except that Solid solution magenta pigment (1) was replaced by 7 wt. parts of C.I. Pigment Red 122. The magenta toner particles exhibited D4=6.2 $\mu$m, $\sigma_{DN}$=58% and SF-1=109.

C.I. Pigment Red 122 used above was subjected to a sedimentation test in a monomer mixture similarly as in Example 1, whereby the colorant was precipitated in ca. 10 hours.

The above-prepared magenta toner particles were formulated into a two-component type developer and evaluated for continuous image formation performances in the same manner as in Example 1. As a result of continuous image formation on 20,000 sheets under the normal temperature/normal humidity conditions, the magenta toner resulted in magenta images accompanied with fog on the non-image portion because of a low chargeability.

Further, the magenta toner exhibited a coloring power lower than that in Example 1 and, particularly a practically insufficient OHP transparency.

Comparative Example 2

Magenta toner particles were prepared in the same manner as in Example 1 except that Solid solution magenta pigment (1) was replaced by 7 wt. parts of C.I. Pigment Violet 19. The magenta toner particles exhibited D4=6.7 $\mu$m, $\sigma_{DN}$=49% and SF-1=106.

The magenta toner particles were formulated into a two-component type developer and evaluated for continuous image formation performances in the same manner as in Example 1. As a result of continuous image formation on 20,000 sheets under the normal temperature/normal humidity conditions, the magenta toner resulted in images of inferior image quality and accompanied with fog from the initial stage because of a low chargeability.

Further, because of poor dispersibility of the colorant in the toner particles, the magenta toner exhibited inferior coloring power, color reproducibility and OHP transparency.

Comparative Example 3

Magenta toner particles were prepared in the same manner as in Example 1 except that Solid solution magenta pigment (1) was replaced by 4.6 wt. parts of C.I. Pigment Red 122 and 2.4 wt. parts of C.I. Pigment Violet 19. The magenta toner particles exhibited D4=5.9 $\mu$m, $\sigma_{DN}$=56% and SF-1=113.

The above-used mixture magenta pigment was subjected to a sedimentation test in a monomer mixture similarly as in Example 1, whereby the colorant was precipitated in ca. 10 hours.

The above-prepared magenta toner particles were formulated into a two-component type developer and evaluated for continuous image formation performances in the same manner as in Example 1. As a result of continuous image formation on 20,000 sheets under the normal temperature/normal humidity conditions, the magenta toner gradually resulted in inferior images accompanied with fog as the image formation was continued.

Further, because of poor dispersibility of the colorant in the toner particles than in Example 1, the magenta toner exhibited inferior coloring power and OHP transparency, and particularly inferior color reproducibility.

Comparative Example 4

Magenta toner particles were prepared in the same manner as in Example 1 except that the saturated polyester resin (polar resin) was replaced by a saturated polyester resin (less polar resin) (obtained by polycondensation of bisphenol A/phthalic anhydride/succinic acid; A.V.=2 mgKOH/g, Mn=4500, Mp=6500). The magenta toner particles exhibited D4=6.2 $\mu$m, $\sigma_{DN}$=74% and SF-1=109.

The magenta toner particles were formulated into a two-component type developer and evaluated for continuous image formation performances in the same manner as in Example 1. As a result of continuous image formation, the magenta toner exhibited a lower charging stability than in Example 1 and resulted in images accompanied with fog as the image formation was continued.

Further, because of poor dispersibility of the colorant in the magenta toner particles, the magenta toner exhibited inferior results with respect to any of the coloring power, color reproducibility and OHP transparency than in Example 1.

Comparative Example 5

Magenta toner particles were prepared in the same manner as in Example 1 except that the saturated polyester resin (polar resin) was replaced by a saturated polyester resin (excessively polar resin) (obtained by polycondensation of terephthalic acid/propylene oxide-modified bisphenol A/trimellitic acid; A.V.=26 mgKOH/g, Mn=8900, Mp=15,000). The magenta toner particles exhibited D4=8.7 $\mu$m, $\sigma_{DN}$=54% and SF-1=123.

The magenta toner particles were formulated into a two-component type developer and evaluated for continuous image formation performances in the same manner as in Example 1. As a result, the magenta toner exhibited less stable chargeability than in Example 1 and resulted in fog.

Further, because of somewhat inferior dispersibility of the colorant, the magenta toner exhibit inferior results with respect to any of the coloring power, color reproducibility and OHP transparency than in Example 1.

EXAMPLE 2

Magenta toner particles were prepared in the same manner as in Example 1 except that the ester wax was replaced by 7 wt. parts of alcohol-modified polypropylene wax ($T_{AP}$=94° C.). The magenta toner particles exhibited D4=7.1 $\mu$m, $\sigma_{DN}$=33% and SF-1=106.

The magenta toner particles were formulated into a two-component type developer and evaluated for continuous image formation performances in the same manner as in Example 1. As a result, the magenta toner provided clear and good magenta images at a stable developing performance.

Because of slightly inferior dispersibility of the colorant than in Example 1, the magenta toner exhibited somewhat worse coloring power, color reproducibility and OHP transparency, but they were all at practically acceptable level.

EXAMPLE 3

Magenta toner particles were prepared in the same manner as in Example 1 except that the saturated polyester resin (polar resin) was replaced by a styrene/acrylic resin (polar resin) (styrene/methacrylic acid/methyl methacrylate copolymer; A.V.=12 mgKOH/g, Mn=6700, Mp=12000). The magenta toner particles exhibited D4=6.4 $\mu$m, $\sigma_{DN}$=30% and SF-1=120.

The magenta toner particles were formulated into a two-component type developer and evaluated for continuous image formation performances in the same manner as in Example 1. As a result, the magenta toner provided clear and good images at a stable developing performance Because of slightly lower dispersibility of the colorant than in Example 1, the magenta toner exhibited somewhat inferior color reproducibility, but it was at a level of practically no problem.

EXAMPLE 4

Magenta toner particles were prepared in the same manner as in Example 1 except that the saturated polyester resin (polar resin) was replaced by 5 wt. parts of an epoxy resin (polar resin) (polycondensation product of bisphenol A/epichlorohydrin/phthalic anhydride/triethylenetetramine; A.V.=3 mgKOH/g, Mn=2800, Mp=7500). The magenta toner particles exhibited D4=5.9 $\mu$m, $\sigma_{DN}$=33% and SF-1=109.

The magenta toner particles were formulated into a two-component type developer and evaluated for continuous image formation performances in the same manner as in Example 1. As a result, the magenta toner caused slight and acceptable level of fog because of a somewhat lower chargeability than in Example 1 and resulted in clear and good magenta images at a practically stable developing performance.

EXAMPLE 5

Magenta toner particles were prepared in the same manner as in Example 1 except that Solid solution magenta pigment (1) was replaced by Solid solution magenta pigment (2). The magenta toner particles exhibited D4 =7.7 μm, $\sigma_{DN}$=35% and SF-1=110.

The magenta toner particles were formulated into a two-component type developer and evaluated for continuous image formation performances in the same manner as in Example 1. As a result, the magenta toner provided clear and good images at a stable developing performance.

Because of a somewhat larger amount of coarse colorant particles in the magenta toner particles, the magenta toner exhibited somewhat worse color reproducibility and coloring power, but they were at levels of practically no problem.

The prescriptions of the toners of Examples and Comparative Examples are summarized in Table 1, and the toner evaluation results are inclusively shown in Table 2.

TABLE 1

| Ex. or Comp. Ex. | Magenta pigment | Polar resin Series | A.V. (kgKOH/g) | Mn | Formula (A) value* |
|---|---|---|---|---|---|
| Ex. 1 | Solid solution pigment (1) | Polyester resin | 15 | 4500 | 10.5 |
| Comp. Ex. 1 | C.I. Pigment Red 122 | Polyester resin | 15 | 4500 | 10.5 |
| Comp. Ex. 2 | C.I. Pigment Violet 19 | Polyester resin | 15 | 4500 | 10.5 |
| Comp. Ex. 3 | C.I. Pigment Red 122<br>C.I. Pigment Violet 19 | Polyester resin | 15 | 4500 | 10.5 |
| Comp. Ex. 4 | Solid solution pigment (1) | Polyester resin | 2 | 4500 | 2.8 |
| Comp. Ex. 5 | Solid solution pigment (1) | Polyester resin | 26 | 4500 | 18.2 |
| Ex. 2 | Solid solution pigment (1) | Polyester resin | 15 | 4500 | 10.5 |
| Ex. 3 | Solid solution pigment (1) | Styrene-acrylic resin | 12 | 6700 | 10.5 |
| Ex. 4 | Solid solution pigment (1) | Epoxy resin | 3 | 2800 | 8.4 |
| Ex. 5 | Solid solution pigment (2) | Polyester resin | 15 | 4500 | 4.2 |

*Formula (A) value = (A.V. (acid value) of polar resin (mgKOH/g) × content (wt. %) of the pigment/content (wt. %) of the polar resin) ≦20.0.

TABLE 2

| Ex. or Comp. Ex. | | $D_4$ (μm) ($\sigma_{DN}$ (%)) | Image quality evaluation: High-light*1 | Color repro.*2 | Coloring power | OHP | Chargeability (mC/kg): L.T./L.H. | N.T./N.H. | H.T./H.H. | Remarks |
|---|---|---|---|---|---|---|---|---|---|---|
| Ex. | 1 | 6.2 (28) | A | A | 1.35 | A | −38 | −33 | −32 | |
| | 2 | 7.1 (33) | B | B | 1.28 | B | −37 | −34 | −32 | |
| | 3 | 6.4 (30) | A | B | 1.31 | A | −37 | −33 | −28 | |
| | 4 | 5.9 (33) | B | A | 1.31 | A | −34 | −26 | −24 | More fine powder was formed during polymerization than other Examples. |
| | 5 | 7.7 (35) | A | B | 1.21 | A | −42 | −36 | −33 | |
| Comp. | 1 | 6.2 (58) | B | C | 1.15 | C | −23 | −18 | −4 | |
| Ex. | 2 | 6.7 (49) | B | C | 0.65 | C | −18 | −12 | 0 | Much agglomerate of pigment in toner particles. |
| | 3 | 5.9 (56) | C | D | 1.00 | C | −16 | −12 | 0 | Much agglomerate of pigment in toner particles. |
| | 4 | 6.2 (74) | B | C | 1.10 | B | −28 | −22 | −18 | Much agglomerate of pigment in toner particles. |
| | 5 | 8.7 (54) | B | B | 1.20 | B | −25 | −15 | −7 | |

*1: Image quality uniformity was evaluated by the uniformity of a highlight level image (I.D. = 0.2).
*2: Color reproducibility range (E) was evaluated based on a high-density image (of I.D. = 1.2).

What is claimed is:

1. A magenta toner for developing an electrostatic image, comprising magenta toner particles containing at least a binder resin, a magenta pigment and a polar resin;

wherein the binder resin comprises a styrene polymer, a styrene copolymer or a mixture thereof, the magenta pigment comprises a solid solution pigment of C.I. Pigment Red 122 and C.I. Pigment Violet 19, or a solid solution pigment of C.I. Pigment Red 202 and C.I. Pigment Violet 19, and the polar resin has an acid value of 3–20 mgKOH/g.

2. The magenta toner according to claim 1, wherein the solid solution pigment comprises C.I. Pigment Red 122 and C.I. Pigment Violet 19 in a weight ratio of 85:15 to 30:70.

3. The magenta toner according to claim 1, wherein the solid solution pigment comprises C.I. Pigment Red 202 and C.I. Pigment Violet 19 in a weight ratio of 85:15 to 30:70.

4. The magenta toner according to claim 1, wherein the magenta toner particles comprise 65–98 wt. % of the binder resin, 1–15 wt. % of the magenta pigment, and 1–20 wt. % of the polar resin.

5. The magenta toner according to claim 1, wherein the magenta toner particles contain 2.0–10.0 wt. % of the magenta toner.

6. The magenta toner according to claim 1, wherein the magenta toner particles comprise the magenta pigment and the polar resin in relative amounts satisfying the following formula (A):

$$5.0 \leqq [\text{acid value of polar resin (mgKOH/g)} \times \text{content (wt. \%) of the solid solution pigment/content (wt. \%) of the polar resin}] \leqq 20.0. \quad \text{Formula (A)}$$

7. The magenta toner according to claim 6, wherein the polar resin is contained in 2.0–10.0 wt. % of the magenta toner particles.

8. The magenta toner according to claim 1, wherein the polar resin comprises a saturated polyester resin.

9. The magenta toner according to claim 8, wherein the saturated polyester resin has a number-average molecular weight of 2,500–10,000.

10. The magenta toner according to claim 1, wherein the polar resin comprises an epoxy resin.

11. The magenta toner according to claim 10, wherein the epoxy resin has a number-average molecular weight of 2,500–10,000.

12. The magenta toner according to claim 1, wherein the polar resin comprises a styrene-(meth)acrylic acid copolymer.

13. The magenta toner according to claim 12, wherein the styrene-(meth)acrylic acid copolymer has a number-average molecular weight of 2,500–10,000.

14. The magenta toner according to claim 1, wherein the magenta toner particles contain a low-softening point substance giving a heat-absorption main peak at 55°–130° C. on a DSC heat-absorption curve.

15. The magenta toner according to claim 14, wherein the magenta toner particles contain 5–25 wt. % of the low-softening point substance.

16. The magenta toner according to claim 15, wherein the low-softening point substance comprises a wax.

17. The magenta toner according to claim 14, wherein the low-softening point substance comprises an ester compound having a long-chain ester unit represented by $R_1$—CO.O— or $R_1$—O.CO—, wherein $R_1$ is an organic group having 15 or more carbon atoms.

18. The magenta toner according to claim 14, wherein the low-softening point substance comprises an ester compound represented by the following formula (1):

$$R_2\text{—COO—}R_3 \quad (1),$$

wherein $R_2$ and $R_3$ denote a saturated hydrocarbon group having 15–45 carbon atoms.

19. The magenta toner according to claim 18, wherein $R_2$ and $R_3$ are alkyl groups.

20. The magenta toner according to claim 14, wherein the low-softening point substance comprises an ester compound represented by the following formula (2):

$$R_4\text{—O.CO—}R_5\text{—CO.O—}R_6, \quad (2)$$

wherein $R_4$ and $R_6$ denote an organic group having 15–32 carbon atoms, and $R_4$ denote an organic group having 2–20 carbon atoms.

21. The magenta toner according to claim 20, wherein $R_4$ and $R_6$ are alkyl groups, and $R_5$ is an alkylene group.

22. The magenta toner according to claim 14, wherein the low-softening point substance comprises an ester compound represented by the following formula (3):

$$R_7\text{—CO.O—}R_8\text{—O.CO—}R_9, \quad (3)$$

wherein $R_7$ and $R_9$ denote an organic group having 15–32 carbon atoms, and $R_8$ denotes an organic group having 2–20 carbon atoms.

23. The magenta toner according to claim 22, wherein $R_7$ and $R_9$ are alkyl groups, and $R_8$ is an alkylene group.

24. The magenta toner according to claim 14, wherein the low-softening point substance comprises an ester compound represented by the following formula (4):

$$[R_{10}\text{—}\underset{\underset{O}{\|}}{C}\text{—O—}(CH_2)_n\text{—}C\text{—}(CH_2)_m\text{—O—}\underset{\underset{O}{\|}}{C}\text{—}R_{11}]_b, \quad (4)$$

wherein $R_{10}$ and $R_{11}$ denote an organic group having 15–4 carbon atoms, a and b are integers of 0–4 giving a sum a+b=4, and m and n are integers of 0–25 giving m+n≧1.

25. The magenta toner according to claim 24, wherein $R_{10}$ and $R_{11}$ are alkyl groups.

26. The magenta toner according to claim 14, wherein the low-softening point substance comprises an ester compound represented by the following formula (R5):

$$[R_{12}\text{—}\underset{\underset{O}{\|}}{C}\text{—O—}(CH_2)_x\text{—}\overset{(R_{14})_z}{\overset{|}{C}}\text{—}(CH_2)_y\text{—O—}\underset{\underset{O}{\|}}{C}\text{—}R_{13}]_d, \quad (5)$$

wherein $R_{12}$ and $R_{13}$ denote an organic group having 15–40 carbon atoms, $R_{14}$ denotes a hydrogen atom or an organic group having 1–40 carbon atoms, c and d are integers of 0–3 giving c+d=1 to 3, z is an integer of 1 to 3.

27. The magenta toner according to claim 26, wherein $R_{12}$, $R_{13}$ and $R_{14}$ are alkyl groups.

28. The magenta toner according to claim 1, wherein the magenta toner particles have a shape factor SF-1 of 100–150.

29. The magenta toner according to claim 1, wherein the magenta toner particles have a shape factor SF-1 of 100–125.

30. The magenta toner according to claim 1, wherein the magenta toner particles contain 0.5–10 wt. % of a negative charge control agent.

31. The magenta toner according to claim 30, wherein the negative charge control agent comprises an aromatic hydroxycarboxylic acid metal compound.

32. The magenta toner according to claim 1, wherein the magenta toner particles comprise polymerized magenta toner particles produced by forming particles of a polymerizable monomer mixture comprising at least styrene monomer, a magenta pigment, a polar resin and a polymerization initiator in an aqueous dispersion medium, and polymerizing the styrene monomer in the particles dispersed in the aqueous medium.

33. The magenta toner according to claim 32, wherein the polymerizable monomer mixture further contains an acrylate ester monomer or a methacrylate ester monomer, and the resultant magenta toner particles contain a styrene-(meth) acrylate copolymer.

34. The magenta toner according to claim 1, wherein the magenta toner particles have a weight-average particle size of 3–9 μm.

35. The magenta toner according to claim 1, wherein the magenta toner particles have a weight-average particle size of 3–8 μm.

36. A process for producing a magenta toner comprising magenta toner particles, comprising the steps of:

mixing at least one monomer including at least styrene monomer and optional another vinyl monomer, a magenta pigment, a polar resin and a polymerization initiator to prepare a polymerizable monomer mixture, dispersing the polymerizable monomer mixture into an aqueous medium to form particles of the polymerizable monomer mixture, and polymerizing said at least one monomer in the particles of the polymerizable monomer mixture to form a binder resin and convert the particles into magenta toner particles;

wherein the binder resin comprises a styrene polymer, a styrene copolymer or a mixture thereof, the magenta pigment comprises a solid solution pigment of C.I. Pigment Red 122 and C.I. Pigment Violet 19, or a solid solution pigment of C.I. Pigment Red 202 and C.I. Pigment Violet 19, and the polar resin has an acid value of 3–20 mgKOH/g.

37. The process according to claim 36, wherein the polymerizable monomer mixture is formed by first mixing said at least one monomer, the magenta pigment and the polar resin, and then adding thereto the polymerization initiator.

38. The process according to claim 36, wherein the polymerizing step for converting the particles of the polymerizable monomer mixture into magenta toner particles is performed by suspension polymerization in water.

39. The process according to claim 36, wherein the solid solution pigment comprises C.I. Pigment Red 122 and C.I. Pigment Violet 19 in a weight ratio of 85:15 to 30:70.

40. The process according to claim 36, wherein the solid solution pigment comprises C.I. Pigment Red 202 and C.I. Pigment Violet 19 in a weight ratio of 85:15 to 30:70.

41. The process according to claim 36, wherein the magenta toner particles comprise 65–98 wt. % of the binder resin, 1–15 wt. % of the magenta pigment, and 1–20 wt. % of the polar resin.

42. The process according to claim 36, herein the magenta toner particles contain 2.0–10.0 wt. % of the magenta toner.

43. The process according to claim 36, wherein the magenta toner particles comprise the magenta pigment and the polar resin in relative amounts satisfying the following formula (A):

$$5.0 \leqq [\text{acid value of polar resin (mgKOH/g)} \times \text{content (wt. \%) of the solid solution pigment/content (wt. \%) of the polar resin}] \leqq 20.0. \qquad \text{Formula (A)}$$

44. The process according to claim 43, wherein the polar resin is contained in 2.0–10.0 wt. % of the magenta toner particles.

45. The process according to claim 36, wherein the polar resin comprises a saturated polyester resin.

46. The process according to claim 45, wherein the saturated polyester resin has a number-average molecular weight of 2,500–10,000.

47. The process according to claim 36, wherein the polar resin comprises an epoxy resin.

48. The process according to claim 47, wherein the epoxy resin has a number-average molecular weight of 2,500–10,000.

49. The process according to claim 36, wherein the polar resin comprises a styrene-(meth)acrylic acid copolymer.

50. The process according to claim 49, wherein the styrene-(meth)acrylic acid copolymer has a number-average molecular weight of 2,500–10,000.

51. The process according to claim 36, wherein the magenta toner particles contain a low-softening point substance giving a heat-absorption main peak at 55°–130° C. on a DSC heat-absorption curve.

52. The process according to claim 51, wherein the magenta toner particles contain 5–25 wt. % of the low-softening point substance.

53. The process according to claim 52, wherein the low-softening point substance comprises a wax.

54. The process according to claim 51, wherein the low-softening point substance comprises an ester compound having a long-chain ester unit represented by $R_1$—CO.O— or $R_1$—O.CO—, wherein $R_1$ is an organic group having 15 or more carbon atoms.

55. The process according to claim 51, wherein the low-softening point substance comprises an ester compound represented by the following formula (1):

$$R_2\text{—COO—}R_3, \qquad (1)$$

wherein $R_2$ and $R_3$ denote a saturated hydrocarbon group having 15–45 carbon atoms.

56. The process according to claim 55, wherein $R_2$ and $R_3$ are alkyl groups.

57. The process according to claim 51, wherein the low-softening point substance comprises an ester compound represented by the following formula (2):

$$R_4\text{—O.CO—}R_5\text{—CO.O—}R_6, \qquad (2)$$

wherein $R_4$ and $R_6$ denote an organic group having 15–32 carbon atoms, and $R_4$ denote an organic group having 2–20 carbon atoms.

58. The process according to claim 57, wherein $R_4$ and $R_6$ are alkyl groups, and $R_5$ is an alkylene group.

59. The process according to claim 51, wherein the low-softening point substance comprises an ester compound represented by the following formula (3):

$$R_7\text{—CO.O—}R_8\text{—O.CO—}R_9, \qquad (3)$$

wherein $R_7$ and $R_9$ denote an organic group having 15–32 carbon atoms, and $R_8$ denotes an organic group having 2–20 carbon atoms.

60. The process according to claim 59, wherein $R_7$ and $R_9$ are alkyl groups, and $R_8$ is an alkylene group.

61. The process according to claim 51, wherein the low-softening point substance comprises an ester compound represented by the following formula (4):

$$[R_{10}\text{—}\underset{\underset{O}{\|}}{C}\text{—O—}(CH_2)_n]_a C[(CH_2)_m O\text{—}\underset{\underset{O}{\|}}{C}\text{—}R_{11}]_b, \qquad (4)$$

wherein $R_{10}$ and $R_{11}$ denote an organic group having 15–4 carbon atoms, a and b are integers of 0–4 giving a sum a+b=4, and m and n are integers of 0–25 giving m+n≧1.

62. The process according to claim 61, wherein $R_{10}$ and $R_{11}$ are alkyl groups.

63. The process according to claim 51, wherein the low-softening point substance comprises an ester compound represented by the following formula (5):

$$[R_{12}\text{—}\underset{\underset{O}{\|}}{C}\text{—O—}(CH_2)_x]_c C[(CH_2)_y O\text{—}\underset{\underset{O}{\|}}{C}\text{—}R_{13}]_d, \qquad (5)$$

wherein $R_{12}$ and $R_{13}$ denote an organic group having 15–40 carbon atoms, $R_{14}$ denotes a hydrogen atom or an organic group having 1–40 carbon atoms, c and d are integers of 0–3 giving c+d=1 to 3, z is an integer of 1 to 3.

64. The process according to claim 63, wherein $R_{12}$, $R_{13}$ and $R_{14}$ are alkyl groups.

65. The process according to claim 36, wherein the magenta toner particles have a shape factor SF-1 of 100–150.

66. The process according to claim 36, wherein the magenta toner particles have a shape factor SF-1 of 100–125.

67. The process according to claim 36, wherein the magenta toner particles contain 0.5–10 wt. % of a negative charge control agent.

68. The process according to claim 67, wherein the negative charge control agent comprises an aromatic hydroxycarboxylic acid metal compound.

69. The process according to claim 36, wherein the magenta toner particles have a weight-average particle size of 3–9 $\mu$m.

70. The process according to claim 36, wherein the magenta toner particles have a weight-average particle size of 3–8 $\mu$m.

* * * * *

UNITED STATES PATENT AND TRADEMARK OFFICE

CERTIFICATE OF CORRECTION

PATENT NO. : 5,811,213
DATED : September 22, 1998
INVENTOR(S) : Tatsuhiko Chiba

It is certified that error appears in the above-identified patent and that said Letters Patent is hereby corrected as shown below:

Column 21,
Line 56, "$R_4$ denote" should read -- $R_5$ denotes --.

Column 22,
Line 10, "15-4" should read -- 15-40 --.

Column 24,
Line 23, "$R_4$ denote" should read -- $R_5$ denotes --;
Line 45, "15-4" should read -- 15-40 --.

Signed and Sealed this

First Day of January, 2002

*Attest:*

*Attesting Officer*

JAMES E. ROGAN
*Director of the United States Patent and Trademark Office*